US005219248A

United States Patent [19]

Wright

[11] Patent Number: 5,219,248

[45] Date of Patent: Jun. 15, 1993

[54] MINE ROOF EXPANSION ANCHOR WITH IMPROVED BORE HOLE ENGAGEMENT MEANS AND METHOD OF INSTALLATION THEREOF

[75] Inventor: Raymond L. Wright, Syracuse, N.Y.

[73] Assignee: The Eastern Company, Naugatuck, Conn.

[21] Appl. No.: 883,115

[22] Filed: May 14, 1992

[51] Int. Cl.[5] ..... E21D 20/00

[52] U.S. Cl. ..... 405/259.4; 405/259.1; 411/65; 411/67

[58] Field of Search ..... 405/259.1, 259.2, 259.4, 405/259.5; 411/63, 65, 67, 68, 64, 66

[56] References Cited

U.S. PATENT DOCUMENTS

| | | | |
|---|---|---|---|
| 2,799,201 | 7/1957 | Genter | 411/67 |
| 3,620,120 | 11/1971 | Warner | 411/67 X |
| 3,726,181 | 4/1973 | Dickow et al. | 85/75 |
| 3,896,627 | 7/1975 | Brown | 61/45 B |
| 3,941,028 | 3/1976 | Lobello et al. | 85/73 |
| 4,437,795 | 3/1984 | White | 405/259.4 X |
| 5,018,908 | 5/1991 | Laphon | 405/259 |
| 5,028,188 | 7/1991 | Prince | 411/67 |
| 5,033,910 | 7/1991 | Wright | 405/259.5 X |
| 5,094,577 | 3/1992 | Clark et al. | 405/259.1 X |

FOREIGN PATENT DOCUMENTS

| | | | |
|---|---|---|---|
| 2434502 | 1/1976 | Fed. Rep. of Germany | 411/68 |
| 1128024 | 8/1956 | France | 411/64 |

*Primary Examiner*—Dennis L. Taylor
*Assistant Examiner*—Arlen L. Olsen
*Attorney, Agent, or Firm*—Charles S. McGuire

[57] ABSTRACT

A mine roof expansion anchor having a conventional tapered camming plug and radially expansible shell having associated therewith an element which resiliently engages the wall of a bore hole as a roof bolt carrying the anchor is inserted in the hole. The resilient element may be incorporated in the structure of a bail having bore wall engagement portions position in a plane closer to the lower end of the expansion shell than the lowest position of the tapered plug after full expansion. The engagement portions may comprise outwardly and downwardly extending portions of the bail legs, either at the terminal ends or pierced from the bail material slightly above the ends. In another embodiment, the engagement portions extend from a support nut positioned on the bolt below the lower end of the shell.

31 Claims, 6 Drawing Sheets

MINE ROOF EXPANSION ANCHOR WITH IMPROVED BORE HOLE ENGAGEMENT MEANS AND METHOD OF INSTALLATION THEREOF

BACKGROUND OF THE INVENTION

The present invention relates to mechanical expansion anchors for use with elongated bolts and bearing plates in the reinforcement and support of rock formations such as mine roofs, and to methods of fabrication and installation thereof. More specifically, the invention relates to novel means for inhibiting rotation of a mechanical anchor within a drill hole as the bolt is rotated to effect expansion of the anchor shell.

Mechanical expansion anchors, sometimes used in combination with a hardenable resin to provide a combined mechanical-chemical anchor, have for many years been the most widely used means of reinforcing and supporting underground rock formations such as mine roofs. Conventional expansion anchors include a hollow shell structure having a plurality of leaves arranged about a central axis, and a tapered camming plug. The small end of the plug extends into one end of the shell and the leaves are moved radially outwardly from the central axis by movement of the progressively larger portion of the plug into the area between the leaves. The anchor is carried on one end of an elongated bolt which is inserted in a drill hole of predetermined depth and diameter in the rock structure.

The distal end of the bolt, i.e., the end of the bolt which is inserted into the hole is externally threaded, and a central, through opening in the tapered plug is internally threaded for mating engagement with the bolt. Means such as a bail or support nut are provided for maintaining the plug and shell in assembled relation on the bolt, and for restraining axial movement of the shell while rotation of the bolt moves the plug into the shell to effect expansion thereof. Support nuts used in such applications are often fabricated of sheet metal with only a single full thread revolution. Many types and configurations of bails have been devised, some of which are specifically discussed hereinafter.

In order for the shell to expand in the intended manner, it is necessary that the anchor be restrained against rotation as the bolt is rotated, and that the shell be restrained against axial movement as the plug moves axially upon the bolt due to its threaded engagement therewith. Frictional contact of the outer surface of the shell with the bore hole wall, and engagement of the small end of the plug in the end of the shell are usually relied upon to provide the required rotational constraint, although other means associated with the anchor have also been proposed. The support nut or bail, each of which are in mutual engagement with both the shell and the bolt, provide the restraint against axial movement of the shell.

A problem which sometimes arises in the use of mechanical mine roof anchors is that of so-called "spinners." That is, due to such factors as soft rock strata, bore hole diameter greater than that of the shell, binding or galling of the threaded connection between bolt and plug, etc., the anchor may not be rotationally restrained to the extent required. The entire anchor then rotates together with the bolt and does not expand. Obviously, in such cases no anchorage for the bolt and no support or reinforcement for the rock formation is provided.

One previously disclosed expansion anchor having means intended to prevent spinners is that of U.S. Pat. No. 5,033,910 of the present inventor wherein friction teeth extend integrally from the outer surface of the shell. These teeth are intended to extend outwardly a distance sufficient to positively engage the bore hole wall and ensure that the anchor does not spin as the bolt is rotated. Being a rigid portion of the shell, there is the possibility that such teeth may interfere with free insertion of the bolt and anchor into the bore hole. Conversely, if the bore hole is oversize, the rigid teeth may not provide sufficient frictional contact with the bore hole wall to provide the required rotational constraint.

Other means for engaging the bore hole wall to inhibit rotation of the anchor have been proposed as a part of or in association with bail structure. For example, U.S. Pat. No. 5,018,908 of Laphon discloses an anchor including a bail having arms extending outwardly from the upper, medial portion of the bail which is positioned over the tapered plug. The arms are resiliently deformable as the anchor is inserted in the bore hole, and terminal ends of the arms engage the bore hole wall to retard or inhibit rotation of the anchor. The arms are separate from and in addition to the portions of the bail structure which extend from the medial portion for engagement with the shell. Furthermore, as the arms engage the bore hole wall they are flexed inwardly against the upper end of the plug, thus causing an undesired resistance to downward movement of the plug to effect shell expansion.

While the advantages of means frictionally engaging the bore hole wall to inhibit rotation of the anchor during shell expansion have been recognized, the previously disclosed means have not proved entirely satisfactory. Accordingly, it is a primary object of the present invention to provide novel and effective means associated with a mine roof expansion anchor for frictionally engaging the bore hole wall in the unexpanded condition of the anchor to inhibit rotation thereof.

It is a further object to provide an expansion anchor having a tapered plug which is moved axially away from the distal end of a threaded bolt in response to bolt rotation to effect radial expansion of a shell within a bore hole including means for inhibiting rotation of the anchor as the bolt is rotated without interfering with axial movement of the plug to effect shell expansion.

Another object is to provide a bail-type mine roof expansion anchor having conventional expansible shell and tapered plug structure in combination with a bail having tabs or arms which extend outwardly from the unexpanded shell to frictionally engage the bore hole wall at a location which effectively inhibits rotation of the anchor while ensuring shell expansion in the intended manner.

A still further object is to provide a novel and improved bail configuration for use with an otherwise conventional mine roof expansion anchor.

Still another object is to provide a novel and improved method of installing a mine roof expansion anchor in a bore hole on the threaded, distal end of an elongated bolt to significantly enhance proper installation of the anchor and tensioning of the bolt.

Other objects will in part be obvious and will in part appear hereinafter.

SUMMARY OF THE INVENTION

As previously mentioned, prior art expansion anchors designed with means for frictionally engaging the bore hole wall to inhibit rotation of the anchor as the bolt is rotated have not proved entirely satisfactory. After experimentation and analysis it has been concluded that the inward force exerted on the means which engages the bore hole wall is applied either to the tapered plug or the upper parts of a two-piece shell, in each case inhibiting axial movement of the plug and expansion of the shell. In this case, the medial portion of the bail which extends over the plug and is contacted by the distal end of the bolt becomes the weak link in the system. The resistance of this portion of the bail against the end of the bolt is no longer sufficient to drive the plug downward, i.e., away from the distal end of the bolt, into the shell leaves before bail failure in the area where it is contacted by the bolt.

It has been found that this problem is effectively overcome by positioning the means contacting the bore hole wall farther from the distal end of the bolt than in prior art designs. Preferably, the wall engaging means is positioned closely adjacent or below the lower end of the shell, i.e., the end farthest from the distal end of the bolt.

In a first disclosed embodiment, the bail includes outwardly flared terminal end portions adjacent the lower end of the shell. The bolt, tapered plug and shell structure are of conventional design. The expansion shell is formed in two identical, physically separate halves joined at or near their lower ends to the bail legs. Each shell half includes a pair of leaves which are separated by a gap extending from their upper ends to a bridge portion by which the leaves are connected to one another adjacent their lower ends.

The bail legs extend from the medial portion of the bail, through the gaps between the leaves, and are staked to the bridge portions of the shell halves. The bail legs are bent outwardly at positions immediately below their staked connections to the shell halves. The terminal ends of the bail legs are closely adjacent, preferably slightly below, the plane of the lower ends of the shell halves. Prior to insertion of the anchor into the bore hole, the terminal ends of the bail legs are spaced by a distance greater than the diameter of the bore hole. Thus, as the anchor is inserted, the terminal ends of the bail legs engage the bore hole wall and are resiliently forced inwardly, maintaining tight frictional engagement with the bore hole wall.

When the bolt, carrying the anchor on its distal end in threaded engagement with the tapered plug, is fully inserted in the drill hole, it is rotated to move the tapered plug axially on the bolt and expand the shell. The tight frictional engagement of the terminal ends of the bail legs with the bore hole wall inhibits rotation of the anchor as the bolt is rotated. Furthermore, the engagement means, due to its position relative to the other elements of the anchor, does not interfere with and, in fact, enhances movement of the plug and/or expansion of the shell. The invention thus provides a means and method of installing an expansion anchor in a bore hole by rotation of a bolt which more reliably results in proper and complete installation.

Several modifications of the embodiment employing separate shell halves connected at their lower ends to the bail legs are disclosed. The bail legs in one configuration are of equal length with terminal ends at the same axial position relative to the bolt, while in another configuration the bail legs are of unequal length. In the latter case, the terminal end of one leg is outwardly adjacent the lower end of the shell while the terminal end of the other leg is spaced axially below the lower end of the shell. The two terminal ends of the bail are equally spaced radially from the bolt axis by a distance which permits insertion of the anchor through the central opening of a roof plate by passing the terminal ends through the opening one at a time. Another modification of this type of anchor involves the structure of the bridge portions of the shell halves, either providing or omitting an end stop underlying the outwardly flared portions of the bail legs.

In a second embodiment, portions are pierced from the bail legs above the lower ends, but below the lower end of the plug. The pierced portions are bent to extend outwardly and downwardly from the bail legs proper, and provide arms which engage the bore hole wall to inhibit rotation of the anchor. This embodiment may be used with shell structure of either the type having separate shell halves, or a one-piece shell having a plurality of leaf fingers extending integrally from a ring at the bottom of the shell.

A third disclosed embodiment includes a one-piece shell and a bail having legs which extend through gaps between adjacent fingers on diametrically opposite sides of the shell, and through the ring at the lower end of the shell. The bail legs are bent to extend outwardly and downwardly below the shell to terminal ends which frictionally engage the bore hole wall as the bolt and anchor are inserted therein. Since the bail is not fixedly attached to the shell, the lower end of each bail leg is flexed inwardly by contact of the terminal ends with the bore hole wall. However, relative dimensions are such that the bolt serves as a stop to limit inward deflection of the bail legs to a position wherein the terminal ends are still urged into tight frictional engagement with the bore hole wall. The bail legs extending between the shell fingers provides the desired rotational restraint of the anchor.

A further embodiment omits the bail altogether, utilizing instead a specially constructed shell support nut. Some prior art anchors include a one-piece shell, plug and support nut threaded on the bolt and positioned under the lower end of the shell. In the present invention, the support nut includes detent or clip structure for engagement with the shell, thereby rotationally coupling the support nut and shell, and outwardly and downwardly extending arms which frictionally engage the bore hole wall upon insertion of the bolt and anchor.

The foregoing and other feature of construction and operation of the structure of the invention, as well as the method of anchor installation according to the invention, will be more fully understood and appreciated from the following detailed description, taken in conjunction with the accompanying drawings.

BRIEF DESCRIPTION OF THE DRAWINGS

It will be understood that such terms as upper, lower, downward, etc. are used herein for convenience to refer to the elements in their orientation in a substantially vertical bore hole in a mine roof, or the like, and as illustrated in the accompanying drawings, wherein.

DETAILED DESCRIPTION

Figure 1A:
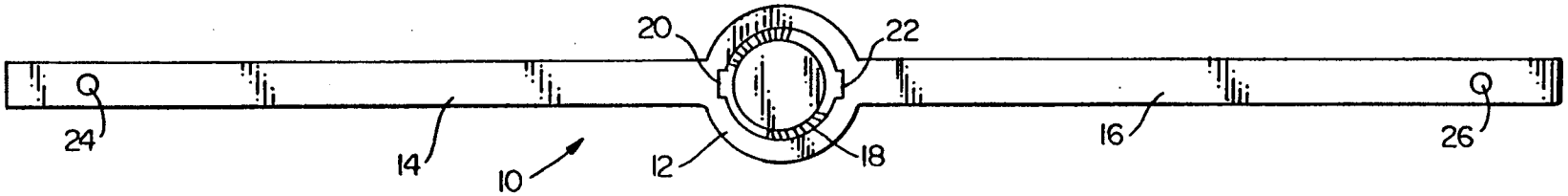
FIGS. 1*a*, 1*b* and 1*c* are plan views of sheet metal blanks from which bail structures embodying the present invention may be fabricated.
Figure 3:
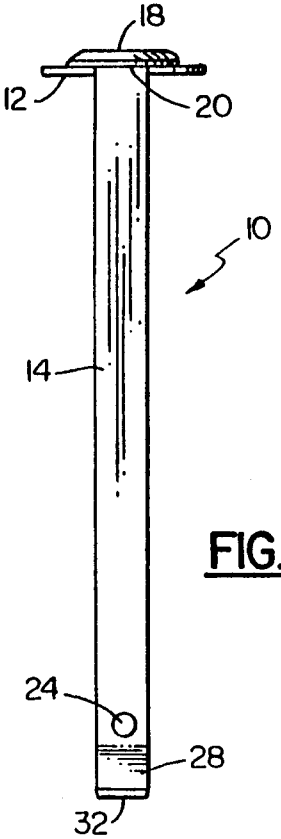
FIG. 3 is a side elevational view of the bail of FIG. 2.
Figure 2:
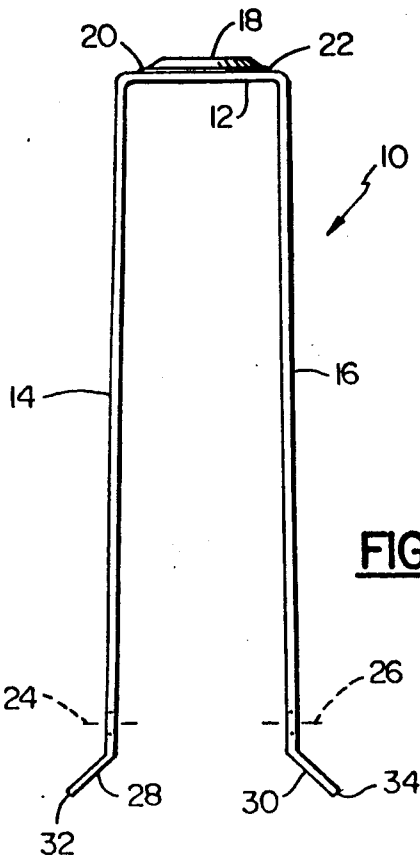
FIG. 2 is a front elevational view of a bail made from the blank of FIG. 1*a* in its finished form.

Referring now to the drawings, in FIGS. 1*a*, 2 and 3 is seen a bail element for incorporation in known fashion with an expansion shell and tapered camming plug to form an expansion anchor assembly. The bail, denoted generally by reference numeral 10, is initially cut as a blank, shown in FIG. 1*a*, from a strip of suitable sheet metal. By way of example, the material from which bail 10 of the disclosed embodiment is formed may be cold-rolled steel, ¼ hard, Rb 60-75, or hot-rolled steel, ¼ hard, pickled and oiled, Rb 60-75, having a thickness of 0.052"±0.002".

Figure 1B:
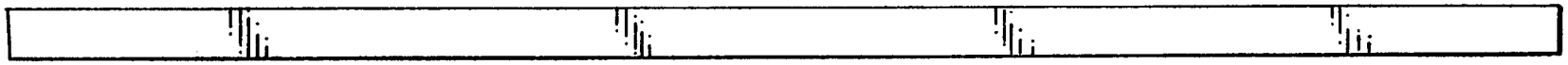
Figure 1C:
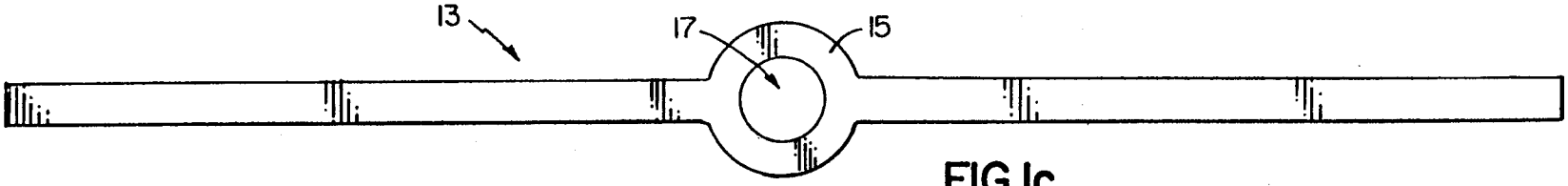
Figure 5:
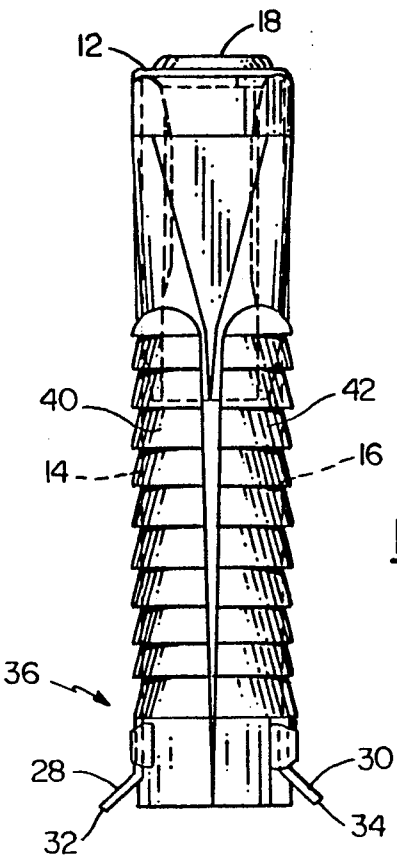
FIG. 5 is a front elevational view of the fully assembled anchor of FIG. 4.

The blank of FIG. 1*a* includes a circular medial portion 12, with legs 14 and 16 of equal length extending in opposite directions therefrom. Medial portion 12 includes a central portion 18, concentric with the peripheral outline, which is stamped or embossed away from the original plane of the material. Central portion 18 is connected to the surrounding medial portion by weakened areas, and by "ties" 20 and 22 on each side, so that it is partially separated from the surrounding area upon installation of the anchor, as more fully described hereinafter. Holes 24 and 26 are punched through the blank on legs 14 and 16. Bail 10 is of the type known as a "popout" bail, although other types may be used within the context of the present invention, as discussed later herein. For example, in FIG. 1*b* is shown blank 11 which is simply an elongated strip of uniform width which may be bent as required to form legs, a medial portion and other features such as those of the bails of FIGS. 11 and 12. Another type of blank 13, having circular medial portion 15 through opening 17, having a diameter smaller than that of the bolt to be used in conjunction therewith, is shown in FIG. 1*c*.

After the blank of FIG. 1*a* is stamped, bail 10 is formed by bending at the juncture of legs 14 and 16 with medial portion 18 so that the legs extend substantially parallel to one another and at substantially 90° prior to assembly of the bail and shell. Legs 14 and 16 are each bent outwardly at a position slightly below holes 24 and 26, providing outwardly and downwardly extending portions 28 and 30 between the bends and terminal ends 32 and 34 of legs 14 and 16, respectively. Although the acute angle of the bend in each leg is not critical, it is preferably about 45°. The outward extent of portions 28 and 30 is also not critical, being determined to some extent by the anticipated difference in diameter, if any, of the unexpanded anchor and the bore hole. By way of example, for 1¼" and 1⅜" anchors to be used in bore holes of the same respective nominal diameters, terminal ends 32 and 34 may each be spaced radially outward from the plane of the outer surface of the bail leg by about ⅛".

After forming of the bail is complete, it is assembled with the shell and plug elements to provide the completed anchor assembly. A conventional form of expansion shell and tapered plug structure, of the type disclosed in U.S. Pat. No. 5,094,577, is shown in FIGS. 4–7, although it is contemplated that the invention may be employed with a wide variety of shells and plugs. The shell is formed as two identical, physically separate halves 36 and 38. Shell halves 36 and 38 each include a pair of leaves 40 and 42, respectively. The leaves of each shell half are separated by an axially extending gap 44 (FIG. 4) extending from the upper ends of the leaves to a bridge portion 46 by which the leaves are joined at their lower ends. Stud 48 is positioned within, and ears 50 on opposite sides of a recessed area in each of bridge portions 46, as explained later in more detail.

Plug 52 tapers inwardly from large end 54 to small end 56. Threaded bore 58 extends axially through plug 52. The elements are assembled by bringing the shell halves together, placing small end 56 of plug 52 into the opening formed by the upper ends of the shell halves, and positioning bail 10 with medial portion 12 extending over large end 54 of the plug, legs 14 and 16 extending through gaps 44 between leaves 40 and 42 of each of the shell halves, and studs 48 extending through holes 24 and 26. Studs 48 and ears 50 are then peened over to fixedly attach the bail legs to the shell halves, all as explained more fully in previously mentioned U.S. Pat. No. 5,094,577.

Figure 6:
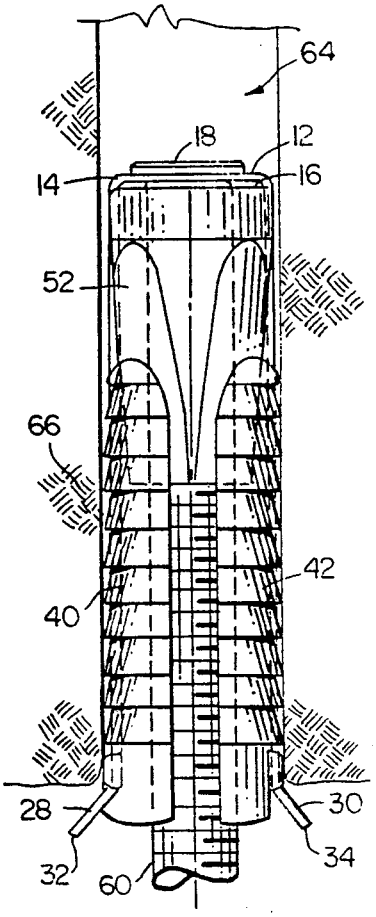
FIG. 6 is a front elevational view of the anchor of FIGS. 4 and 5, mounted on a bolt as it is being inserted into a bore hole in a rock formation, a portion of which is shown in vertical section;.

Conventional mine roof bolt 60 is threaded over a portion of its length from distal end 62 with threads mating with those of plug bore 58. The assembled anchor is mounted upon bolt 60 by inserting distal end 62 through the open, lower end of the anchor, and threading it through bore 58 until it contacts central portion 18 of bail medial portion 12. The proximal end (not shown) of bolt 60 includes an integral head or other means for engagement by a power wrench to effect rotation of the bolt, and normally carries a bearing plate for engagement with the supported rock formation In preparation for installation of the bolt and anchor, bore hole 64 is drilled in rock structure 66 to a predetermined diameter and depth. The distal end of the bolt, with the anchor mounted thereon, is then started into the bore hole, as shown in FIG. 6. The anchor enters hole 64 with little or no frictional resistance until outwardly extending portions 28 and 30 contact the surface of rock formation 66 at the entrance to the hole. Continued advance of bolt 60 causes inward deformation of bail portions 28 and 30. Due to the springy, resilient nature of the bail material, terminal ends 32 and 34 tend to engage the bore hole wall in tightly gripping engagement, enhanced by the rather sharp edges and corners at the terminal ends.

Figure 7:
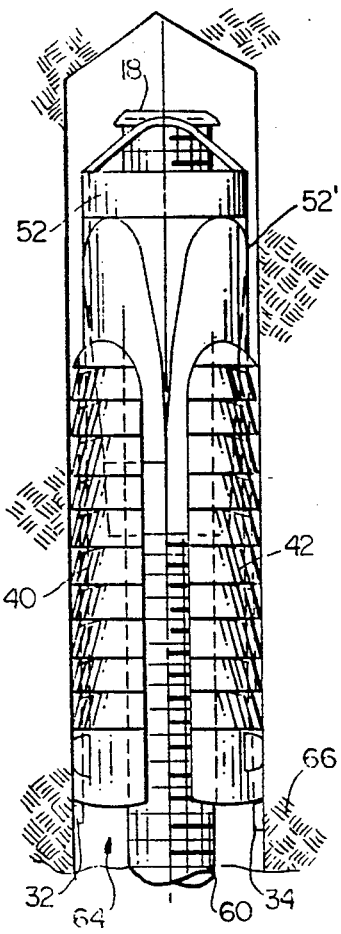
FIG. 7 is a front elevational view of the anchor, showing the manner of installation in the bore hole.
Figure 4:
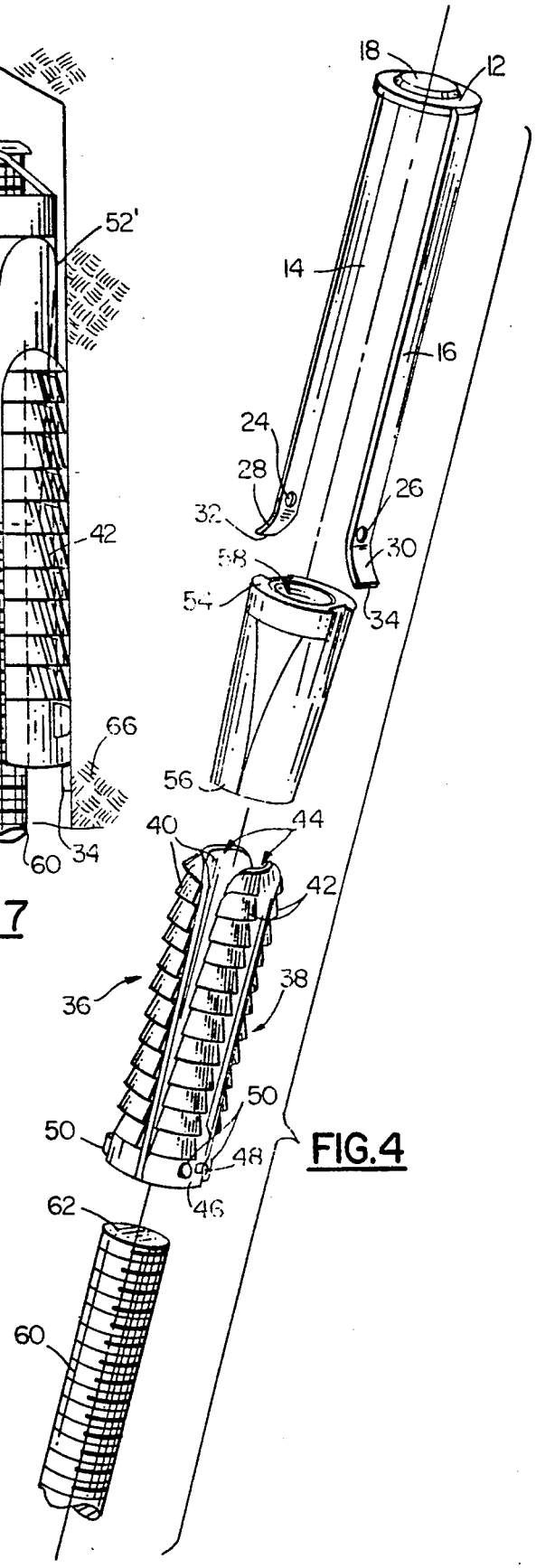
FIG. 4 is an exploded perspective view of an expansion anchor embodying the invention with the bail structure of FIGS. 2 and 3.

The elements are shown in FIG. 7 with the bolt and anchor fully advanced into bore hole 64. Plug 52 is shown in its axial position prior to shell expansion. The depth of bore hole 64 is such that distal end 62 of bolt 60 is spaced a short distance from the blind end of the hole when the bolt is fully installed.

Figure 7A:
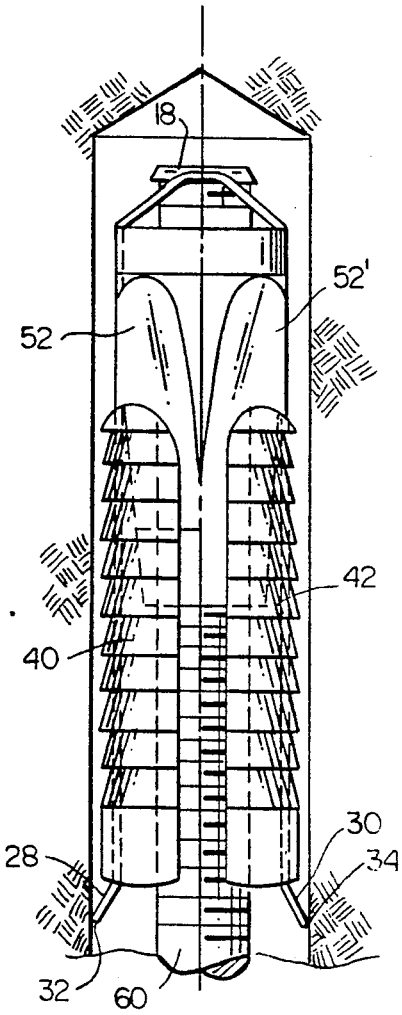
FIG. 7*a* is a front elevational view, as in FIG. 7, of the same anchor installed in a larger diameter bore hole.

Expansion of the anchor and tensioning of the bolt are performed in the usual manner, i.e., when the bolt has been fully advanced to seat the bearing plate against the surface of the rock formation surrounding the open end of the bore hole, the bolt is rotated to move plug 52 axially down the bolt threads, forcing leaves 40 and 42 of shell halves 36 and 38 into tightly gripping engagement with the wall of bore hole 64. A predetermined torque is applied to bolt 60 to ensure that it is tensioned to the required degree. In some installations, the diameter of the bore hole may be as much as ¼ larger than the unexpanded diameter of the shell. Consequently, there will be little or no frictional engagement of the anchor shell with the bore hole wall. Terminal ends 32 and 34 extend radially outwardly a sufficient distance to engage the bore hole wall, as shown in FIG. 7*a*, and provide the necessary restraint to rotation of the anchor.

Figure 8:
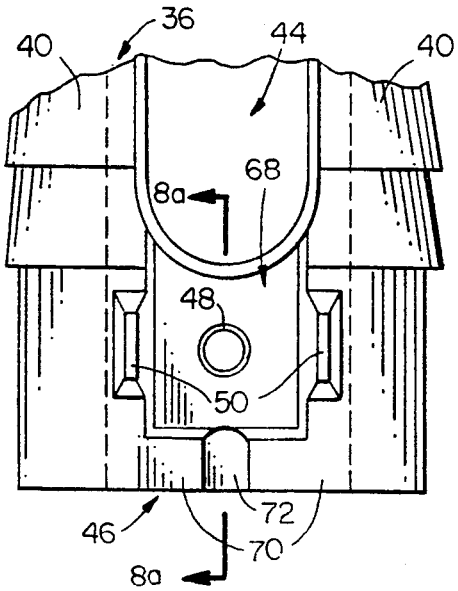
FIG. 8 is a fragmentary, front elevational view of a portion of the lower part of the shell structure of the anchor of FIGS. 4–7.
Figure 8A:
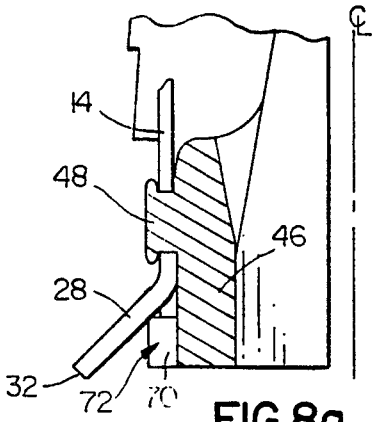
FIG. 8*a* is a side elevational view in section on the line 8*a*—8*a* of FIG. 8, also showing a fragment of the bail element.

Referring now to FIGS. 8–8*a* and 9–9*a*, two configurations of the lower part of the shell structure, for alternate use with the outwardly flared bail legs, are shown. The shell structure of FIGS. 8 and 8*a* conforms to that of previously mentioned U.S. Pat. No. 5,094,577. Bridge portion 46 which joins leaves 40 and 42 of each of shell halves 36 and 38, is recessed in area 68 which extends from the upper end of the bridge portion (i.e., the lower end of gap 44) to shell portions 70 on opposite sides of groove 72. Studs 48 and the portions of bail legs 14 and 16 which lie between ears 50 are located in recessed areas 68 of the shell halves. As seen in FIG. 8*a*, shell portions 70 lie beneath outwardly flared portions 28 and 30 of the bail legs, thereby providing a resistance to the inward deformation of the bail portions as the anchor is inserted into the bore hole.

Figure 9:
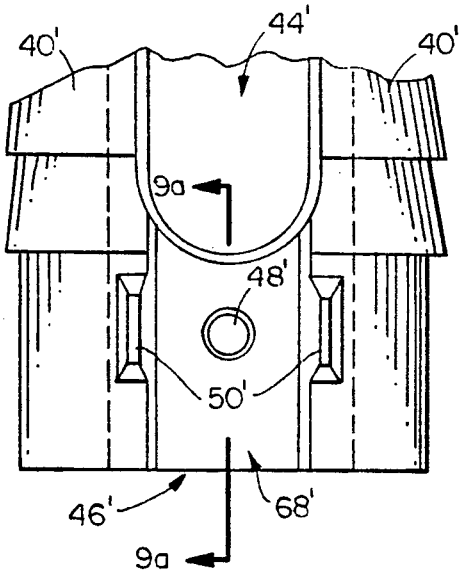
FIG. 9 is a fragmentary, front elevational view of an alternate configuration of the part of the shell structure shown in FIG. 8.
Figure 9A:
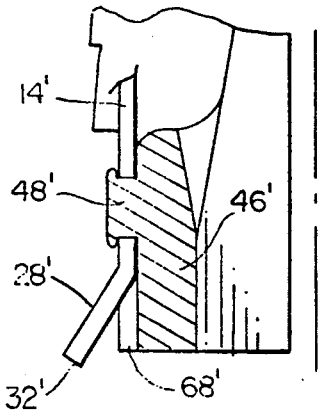
FIG. 9*a* is a side elevational view in section on the line 9*a*—9*a* of FIG. 9, also showing a fragment of the bail element.

In the configuration of FIGS. 9 and 9*a*, wherein shell portions corresponding to those of FIGS. 8 and 8*a* are denoted by like reference numerals with a prime sign added, recessed area 68' of each shell half extends entirely from the upper to the lower end of bridge portion 46. That is, there are no portions 70, as in the FIG. 8–8*a* configuration. Therefore, when the anchor is inserted into the bore hole, the initially flared portions of the bail legs may be deflected into the lower parts of recessed areas 68'.

Figure 10:
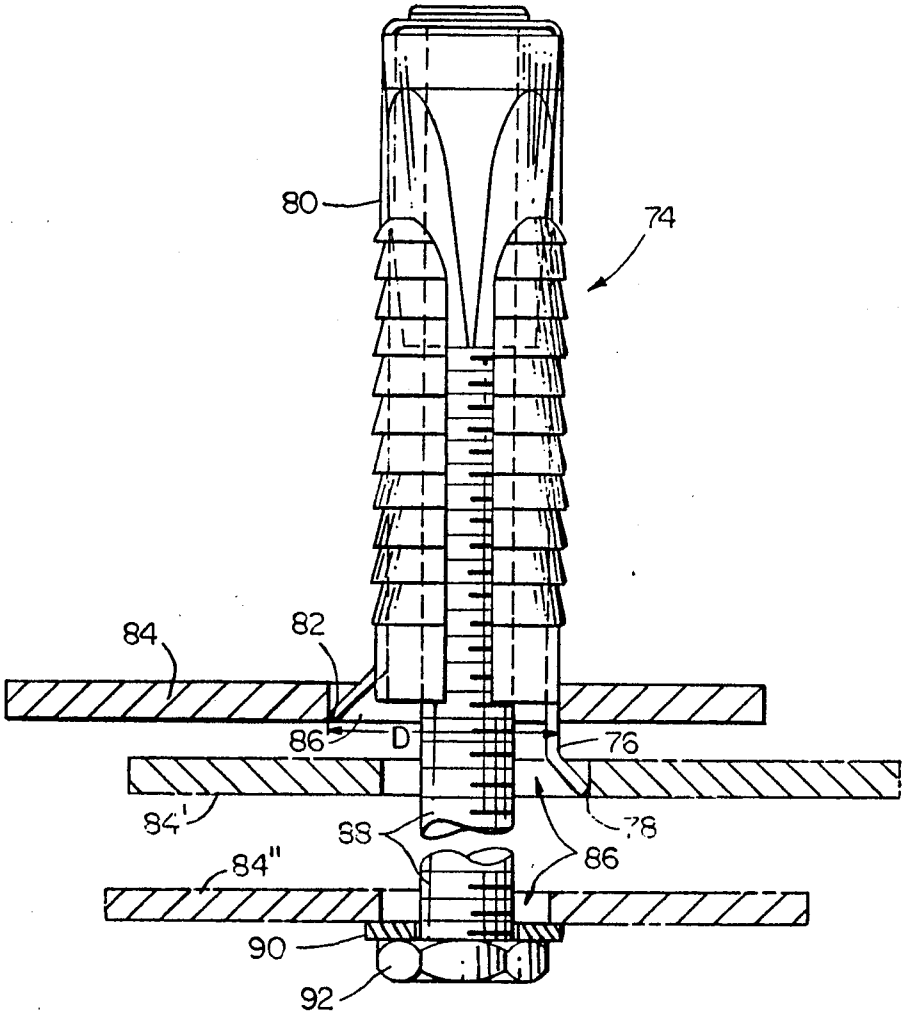
FIG. 10 is a front elevational view of the anchor of FIGS. 5–7 with a modified bail, showing the manner of installation of a roof plate (shown in solid and phantom lines in three, time-spaced positions) on a bolt carrying the anchor.

In FIG. 10 is shown an embodiment of the invention which permits a bearing plate to be placed on the bolt after the anchor is mounted thereon. The anchor of FIG. 10, denoted generally by reference numeral 74, may have a shell and tapered plug of the same design as those of the previously described embodiment. The bail may also be of the same general design, and be attached to the shell halves in the same manner, except that leg 76 extends downwardly for some distance (e.g., about ¾") below the position at which it is secured to the right shell half before being bent to extend outwardly and downwardly to terminal end 78. Leg 80 is bent at the same position as in the previous embodiment to position terminal end 82 approximately laterally adjacent the lower end of the shell.

A conventional bearing plate, also known as a mine roof plate, is shown in upper, intermediate and lower positions, respectively numbered 84, 84' and 84". It will be understood that the same plate is indicated in three, time-spaced positions, the first shown in solid lines and indicated by reference numeral 84, and the second and third shown in phantom lines and indicated by reference numerals 84' and 84", respectively. Central opening 86 in plate 84 has a diameter D which is larger than the diameter of the anchor. The larger diameter of opening 86 permits anchor 74, including terminal end 82 of leg 80 to pass through the plate opening, as shown in the upper position of the plate. As the plate is lowered, it is shifted from left to right, whereby terminal end 78 of leg 76 may pass through opening 86 as shown in plate position 84'.

After passing over terminal end 78, the plate may be shifted laterally to a position wherein bolt 88 is essentially centered in opening 86, and the plate is lowered to position 84", resting upon washer 90. Washer 90 may be formed integrally with bolt 88, as is bolt head 92, or may be a separate element, placed on the bolt prior to mounting anchor 74 thereon. The outer diameter of washer 90 is, of course, larger than the diameter of plate opening 86, and the plate is urged into tight engagement with the portion of the mine roof, or other rock structure surface, surrounding the open end of the bore hole when the anchor is expanded and the bolt tensioned.

Figure 11:
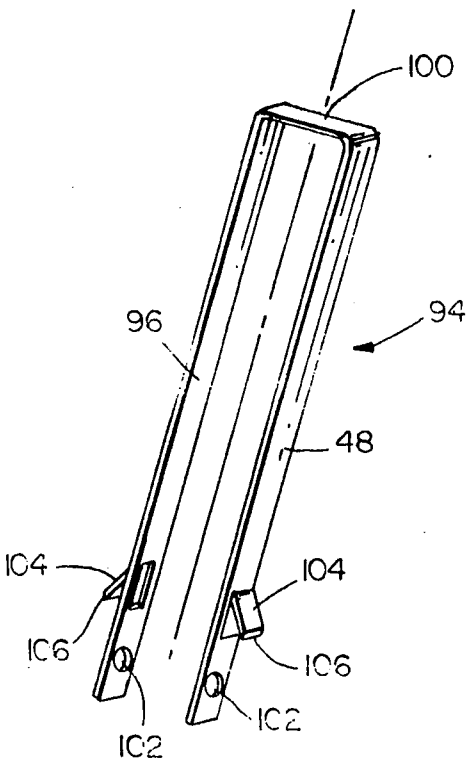
FIG. 11 is a perspective view of another embodiment of bail structure for use in the invention.

A further bail embodiment is illustrated in FIG. 11. Bail 94 includes legs 96 and 98 extending substantially parallel to one another from medial portion 100, in this case straight and of the same width as the legs. Bail 94 may be provided with openings 102 near the lower ends of the legs for attachment to separate shell halves in the same manner as the previously described embodiments, or may be assembled with the shell in other conventional fashion. In this embodiment, instead of bending the bail legs to extend outwardly and downwardly to the terminal ends, tabs 104 are pierced from each of legs 96 and 98, remaining attached thereto at the top, and bent to extend outwardly and downwardly to terminal ends 106. Thus, when bail 94 is assembled with other elements of the anchor and placed on a bolt, terminal ends 106 will frictionally engage the bore hole wall and inhibit rotation of the anchor. It should be noted that tabs 104 will be at a substantially lower position than the lower end of the tapered plug when the anchor elements are assembled.

Figure 12:
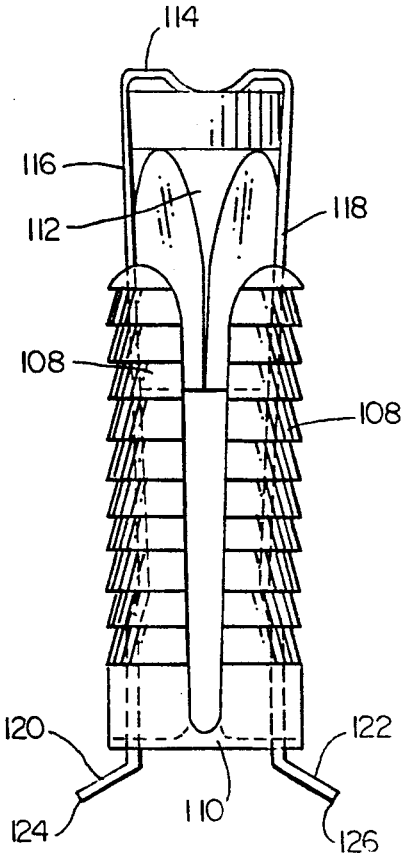
FIG. 12 is a front elevational view of another embodiment of the anchor.
Figure 12A:
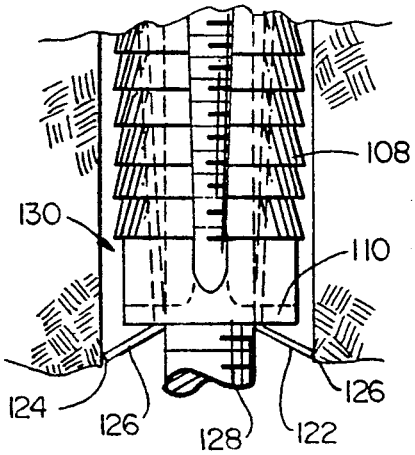
FIG. 12*a* is a front elevational view of the anchor of FIG. 12, shown during insertion into a bore hole.

Turning now to FIGS. 12 and 12*a*, another embodiment of the invention, suitable for employment with one-piece shells, is shown. Again, the shell and plug elements are entirely conventional, being of the design, for example, illustrated and described more fully in U.S. Pat. No. 3,726,181. The shell includes four leaves 108 in the nature of fingers extending integrally from annular ring 110 at the lower end of the shell. Plug 112 is retained in assembled relation with the shell by M-shaped medial portion 114 of the bail, legs 116 and 118 of which extend through the gaps or lateral spaces between adjacent fingers on opposite sides of the shell.

The bail legs extend through the inside of ring 110 and are bent to provide portions 120 and 122, extending outwardly and downwardly to terminal ends 124 and 126, respectively. The distal end of bolt 128 is inserted through ring 110 and threaded into plug 112 until it contacts medial portion 114 of the bail in the usual manner. As the bolt and anchor are inserted into bore hole 130, terminal ends 124 and 126 of the bail legs contact the bore hole wall. Since the bail is physically unattached to the shell, legs 116 and 118 are pushed inwardly by such contact. However, the normal spacing between the inner surfaces of the bail legs inside shell ring 110 and the adjacent surface of bolt 128 is less than the outward extent of terminal ends 124 and 126 from the outer surface of the shell, whereby the bolt acts as a stop to limit inward movement of the bail legs. Thus, terminal ends 124 and 126 will remain in tight frictional engagement with the bore hole wall and, due to the positioning of bail legs 116 and 118 between adjacent shell fingers 108, will restrain the anchor against rotation as bolt 128 is rotated.

Figure 13:
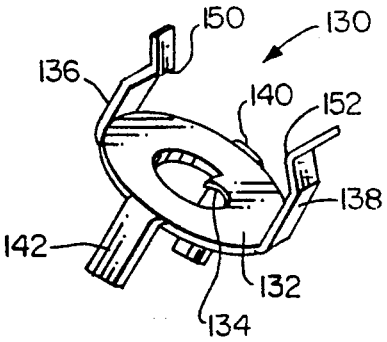
FIG. 13 is a perspective view of a special form of support nut which may be employed in the invention with a shell structure such as that of FIG. 12.

Element 130, representing a further embodiment of the invention, is shown in FIG. 13. Element 130 may be formed from a sheet metal stamping, and includes annular body portion 132 having central opening 134, the edge of which is formed in a spiral to provide a single revolution of a thread mating with a bolt with which element 130 is to be used. Extending upwardly from opposite sides of the outer periphery of body portion 132 are clip portions 136 and 138. Arms 140 and 142 extend outwardly and downwardly from opposite sides of body portion 132 between clip portions 136 and 138.

In use, element 130 serves as a support nut for a one-piece shell, such as that of FIGS. 12 and 12*a*, replacing the bail. That is, bolt 144 is threaded through the single thread of element 130 and a one-piece shell 146 and tapered plug 148 are also placed on the bolt, the latter being threaded through the plug with the lower end of the shell contacting annular portion 132 of element 130. The preferred manner of assembly is to engage element 130 with shell 146 by placing clip portions 136 and 138 over the ring at the lower end of the shell so that inwardly extending portions 150 and 152 are engaged between two adjacent fingers on opposite sides of the shell. This will rotationally lock element 130 and shell 146. Bolt 144 is threaded through opening 134 and on through the threaded bore of tapered plug 148. The elements thus assembled are then ready for insertion and installation in a bore hole.

Figure 14:
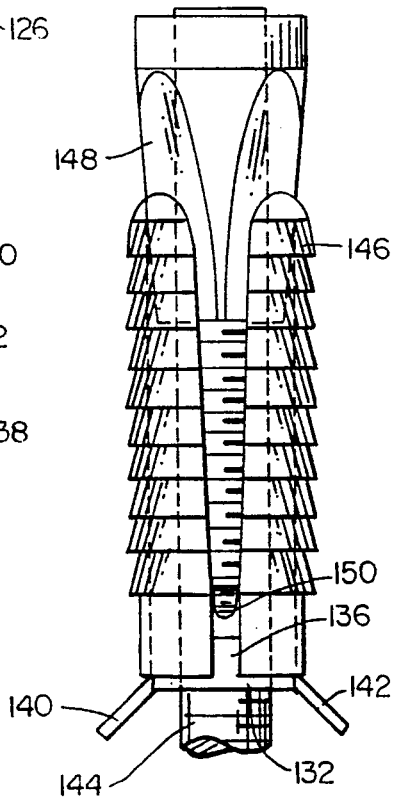
FIG. 14 is a front elevational view of the support nut of FIG. 13 shown with a shell and tapered plug mounted on a bolt during installation in a bore hole.
Figure 14A:
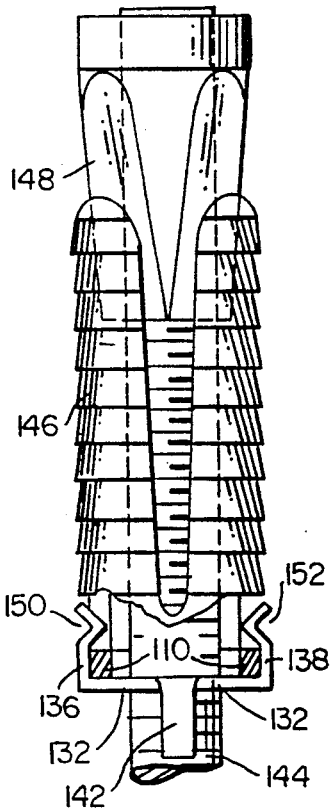
FIG. 14*a* is a side elevational view of the structure of FIG. 14.

As seen in FIGS. 14 and 14*a*, as this embodiment of the invention is inserted in bore hole 154, arms 140 and 142 are positioned to be deflected resiliently inwardly by contact of the terminal ends thereof with the bore hole wall. As bolt 144 is rotated to expand the anchor, the tight frictional engagement of the terminal ends of arms 140 and 142, and the rotational locking of element 130 with shell 146 inhibits rotation of anything other than the bolt.

If desired, a conventional, two-part resin cartridge may be placed in the bore hole in advance of the bolt and anchor in any of the disclosed embodiments. The advance of the bolt crushes the cartridge against the blind end of the bore hole, releasing the contents, which are mixed by rotation of the bolt to form a hardened mass surrounding the anchor and a portion of the bolt. Such combined mechanical-chemical anchors have been in common use for some time.

To reiterate, proper expansion of the anchor and tensioning of the bolt require that the leaves and plug be restrained against rotation as the bolt is rotated. For many years, frictional engagement of the shell leaves with the bore hole wall was relied upon to provide such rotational restraint. However, it was not uncommon to encounter "spinners," a condition where the anchor rotated together with the bolt and expansion either did not occur or was incomplete. Attempts to cope with the problem of spinners have included resilient structure associated with the anchor for frictionally engaging the bore hole wall. Such prior art structures have not proven entirely satisfactory for the intended purpose. The deficiency is due to the fact that the structure engaged the bore hole wall at a position above or not lower than essentially laterally adjacent the lower end of the plug, presenting an impediment to downward movement of the plug. The present invention, by providing structure frictionally engaging the bore hole wall substantially below the lowest position of the plug, and preferably laterally adjacent or below the lower end of the shell, has proven far superior to prior art structures in eliminating the problem of spinners in mechanical mine roof expansion anchors.

What is claimed is:

1. An expansion anchor assembly for insertion in a bore hole of predetermined diameter in a rock formation to anchor firmly within said bore hole the threaded, upper end of a bolt having a lower end positioned outside said bore hole, said assembly comprising, in combination:

a) an expansion shell having a plurality of leaves generally symmetrical about a central axis and radially expansible into gripping engagement with the wall of said bore hole;

b) a tapered camming plug having a larger diameter upper end and a smaller diameter lower end and a through, axial bore for threaded engagement with said bolt upper end for axial movement of said plug in response to rotation of said bolt from a first to a second position to effect radially outward movement of said leaves, said lower end of said plug being axially spaced from said bolt upper end by first and second distances when said plug is in its first and second positions, respectively;

c) an element axially supporting said shell with respect to said plug and bolt in a position wherein said central axis is substantially coaxial with said bolt;

d) means rotationally securing said element to said shell; and e) resilient bore wall engagement means including a portion of said element extending away from said central axis at a position spaced axially from said upper end of said bolt by a distance at least as great as said second distance, said portion extending radially outwardly from said central axis by a third distance greater than one-half of said predetermined diameter, whereby said portion engages and is deflected inwardly by said bore hole wall and inhibits rotation of said assembly upon insertion of said bolt and anchor into said bore hole and rotation of said bolt.

2. The anchor assembly of claim 1 wherein said element comprises a generally U-shaped bail having a medial portion extending over said plug and a pair of legs extending from said medial portion generally parallel to said central axis over at least a major portion of their length to terminal ends.

3. The anchor assembly of claim 2 wherein said bore wall engagement means comprises at least one of said terminal ends.

4. The anchor assembly of claim 3 wherein said bail legs are attached to said shell on opposite sides of said central axis at positions in a substantially common plane transverse to said central axis.

5. The anchor assembly of claim 4 wherein said bail legs extend from said medial portion to said positions of attachment to said shell substantially parallel to said central axis, and extend outwardly at acute angles to the portions of said bail legs between said medial portion and said positions of attachment from positions below said positions of attachment to said terminal ends.

6. The anchor assembly of claim 5 wherein said acute angles are about 45°.

7. The anchor assembly of claim 6 wherein said third distance is at least ⅛ greater than one-half said predetermined diameter.

8. The anchor assembly of claim 2 wherein each of said bail legs extend from said medial portions to terminal ends on opposite sides of said central axis, said terminal ends being laterally spaced from one another by a distance greater than said predetermined diameter and providing said bore wall engagement means.

9. The anchor assembly of claim 8 wherein said shell extends axially between an upper end, into which said plug extends, and said lower end, said legs being physically attached to said shell at positions closely adjacent said lower end.

10. The anchor assembly of claim 9 wherein said bail legs are of unequal length, whereby said terminal ends lie in axially spaced planes along said central axis.

11. The anchor assembly of claim 10 wherein said terminal ends are axially spaced by at least about ½".

12. The anchor assembly of claim 9 wherein said bail legs are substantially equal in length, and said terminal ends lie in a substantially common plane transverse to said central axis.

13. The anchor assembly of claim 12 wherein said lower end of said shell lies in a plane transverse to said central axis closely adjacent said common plane.

14. The anchor assembly of claim 8 wherein said shell comprises a plurality of circumferentially spaced leaves extending integrally from an open, annular ring at said lower end of said shell, said ring having inner and outer surfaces, and each of said bail legs extends downwardly from said medial portion through the spaces between adjacent leaves on opposite sides of said shell and through said ring, said legs being bent at an acute angle to extend outwardly from said central axis and downwardly to said terminal ends.

15. The anchor assembly of claim 14 wherein each of said terminal ends is spaced radially outwardly from said outer surface of said ring by at least about ⅛".

16. The anchor assembly of claim 2 wherein said engagement means comprises at least one portion of said bail exclusive of said terminal ends.

17. The anchor assembly of claim 16 wherein said portion of said bail extends integrally from at least one of said legs at a position above said terminal end thereof at an acute angle, downwardly and outwardly from said one leg, to provide said engagement means.

18. The anchor assembly of claim 1 wherein said shell comprises a plurality of circumferentially spaced leaves extending integrally from an open, annular ring at said lower end of said shell, said ring having inner and outer surfaces, and said element comprises a nut-like member having a body portion with a central opening adapted for threaded engagement with said bolt.

19. The anchor assembly of claim 18 wherein said leaves are spaced from one another by gaps extending upwardly from said ring, and said means rotationally securing said element to said shell comprise at least one member attached to and extending upwardly from said body portion to a position within one of said gaps, between adjacent leaves of said shell.

20. The anchor assembly of claim 18 wherein said engagement means comprises at least one arm affixed to and extending outwardly and downwardly at an acute angle from said body portion.

21. The anchor assembly of claim 18 wherein said leaves are spaced from one another by gaps extending upwardly from said ring, said means rotationally securing said element to said shell comprise a pair of members extending integrally upwardly from said body portion on diametrically opposite sides thereof to positions within two of said gaps between adjacent leaves on diametrically opposite sides of said shell, and said engagement means comprises a pair of arms extending integrally outwardly and downwardly at an acute angle from said body portion.

22. The anchor assembly of claim 21 wherein said element is formed from a one-piece, sheet metal stamping.

23. The combination comprising:

a) a rock formation having a surface and a blind bore hole of substantially uniform diameter extending into said rock structure from an open end in said surface;

b) an elongated bolt having a distal end with external threads extending from said distal end for at least a portion of the length of said bolt;

c) a mechanical expansion anchor assembly mounted upon said bolt distal end and inserted therewith into said bore hole, said assembly including:

i) a shell having a plurality of leaves arranged substantially symmetrically about a central axis and radially moveable between an unexpanded condition, wherein the largest cross-dimension of said leaves is not greater than said uniform diameter, an expanded condition, wherein said leaves are in tightly gripping engagement with the wall of said bore hole; and ii) a camming plug having an outer surface tapering outwardly from a small to a large end and a through, central bore with internal threads engaged with said bolt external threads, said plug being axially moveable in response to rotation of said bolt between a first position, wherein said small end extends a first axial distance into the end of said shell closest to said bolt distal end in the unexpanded condition of said leaves, and a second position, wherein said small end extends a second axial distance, greater than said first distance, into said closest end of said shell in the expanded condition of said leaves; and d) bore hole engagement means, said leaves being rotationally fixed and said bolt being freely rotatable with respect to said engagement means, at least a portion of said engagement means being resiliently deformable from an outer position, spaced from said bolt axis by a distance greater than one-half of said uniform diameter, and an inner position, wherein said portion contacts said bore hole wall and inhibits rotation of said anchor assembly as said bolt is rotated, said engagement means being movable from said outer to said inner position by contact with said bore hole wall as said bolt distal end is moved into said bore hole, said portion of said engagement means being positioned a greater axial distance from said bolt distal end than said second axial distance.

24. The invention according to claim 23 wherein said anchor assembly further includes a bail engaged with said shell, and said portion of said engagement means comprises a portion of said bail.

25. The invention according to claim 24 wherein said bail includes a medial portion extending over said plug large end and leg means having at least one terminal end, remote from said medial portion and forming said portion of said engagement means.

26. The invention according to claim 23 wherein said anchor assembly further includes a bail having a medial portion extending over said plug large end and a pair of legs extending integrally from said medial portion to terminal ends extending outwardly from diametrically opposite sides of said shell adjacent the end thereof farthest from said bolt distal end, said terminal ends providing said bore hole engagement means.

27. The invention according to claim 26 wherein each of said legs is fixedly attached to said shell at positions substantially adjacent the farthest end of said shell farthest from said distal end of said bolt.

28. The invention according to claim 27 wherein said legs extend from said bail medial portion to said positions of attachment to said shell substantially parallel to one another, and are bent at positions below said positions of attachment to extend away from one another from said positions at which they are bent to said terminal ends.

29. The method of installing a mechanical mine roof anchor in a bore hole comprising the steps of:

a) drilling a hole of substantially uniform, predetermined diameter in a rock structure;

b) positioning on the threaded, distal end of an elongated bolt an expansion anchor having a hollow, radially expansible shell, and a tapered camming plug with a central, threaded bore, said anchor being positioned on said bolt by threaded engagement of said bolt distal end with said plug bore, said shell and plug being arranged substantially symmetrically about the axis of said bolt with the larger end of said plug closest to said bolt distal end and the smaller end of said plug extending into the end of said shell closest to said bolt distal end, said shell being radially expansible by axial movement of said plug on said bolt, said smaller plug end being positioned at first and second distances from said bolt distal end before and after, respectively radial expansion of said shell;

c) rotationally coupling to said shell an element while leaving said bolt freely rotatable with respect to said shell and said element;

d) providing at least one resilient member attached to and extending outwardly and downwardly at an acute angle from said element to a terminal end positioned radially outwardly from said bolt axis by a distance greater than one-half said predetermined diameter and axially below said bolt distal end by a distance greater than said second distance;

e) inserting said bolt distal end, said anchor and said element into said bore hole with said bolt axis substantially coaxial with said bore hole, whereby said terminal end contacts and said resilient element is deflected inwardly by the wall of said bore hole; and f) rotating said bolt to effect axial movement of said plug thereon and radial expansion of said shell into tightly gripping engagement with said bore hole wall, rotation of said shell being inhibited by engagement of said terminal end with said bore hole wall and said rotational coupling of said element to said shell.

30. The method of claim 29 wherein said element comprises a bail having a medial portion extending over said larger plug end and bolt distal end and a pair of legs extending downwardly from opposite sides of said medial portion, and including he further step of fixedly attaching each of said legs to said shell at positions adjacent the end of said shell farthest from said bolt distal end.

31. The method of claim 30 wherein said legs extend substantially parallel to one another from said medial portion to said positions of attachment and including the further step of bending each of said legs at positions below said positions of attachment to extend outwardly and downwardly to said terminal ends.

* * * * *